United States Patent [19]

Birtles et al.

[11] Patent Number: 5,054,390

[45] Date of Patent: Oct. 8, 1991

[54] OFF-SET PRINTING BY SILK SCREENING AN INTERMEDIATE SURFACE AND TRANSFERRING THE IMAGE TO AN ARTICLE BY AN OFF-SET PAD

[75] Inventors: John F. Birtles, Newcastle under Lyme; Robert D. Brett, Stoke-on-Trent; Wilfred Roberts, Newcastle under Lyme, all of England

[73] Assignee: British Ceramic Research Association Ltd., Stoke-on-Trent, England

[21] Appl. No.: 149,906

[22] Filed: Jan. 28, 1988

Related U.S. Application Data

[63] Continuation of Ser. No. 720,261, Apr. 5, 1985, abandoned, which is a continuation-in-part of Ser. No. 486,697, Apr. 20, 1983, abandoned.

[51] Int. Cl.[5] ..... B41F 15/00; B41F 17/00

[52] U.S. Cl. ..... 101/114; 101/41; 101/129; 101/163

[58] Field of Search ..... 101/35, 41, 44, 114, 101/129, 163

[56] References Cited

U.S. PATENT DOCUMENTS

| | | | |
|---|---|---|---|
| Re. 30,670 | 7/1981 | Ezumi | 430/303 |
| 105,300 | 7/1870 | Bowdoin | 101/379 |
| 3,255,695 | 6/1966 | Johnson et al. | 101/211 |
| 3,554,836 | 1/1971 | Steindorf | 101/426 |
| 3,701,317 | 10/1972 | Miyamoto et al. | 107/41 X |
| 3,749,593 | 7/1973 | Keiser | 428/447 X |
| 3,756,165 | 9/1973 | Valiela | 101/41 X |
| 3,772,016 | 11/1973 | Anderson, Jr. et al. | 101/459 X |
| 3,819,745 | 6/1974 | Plante | 428/447 |
| 3,925,283 | 12/1975 | Dahl | 524/764 |
| 3,997,496 | 12/1976 | Razzano | 525/477 |
| 4,035,214 | 7/1977 | Shuppert et al. | 101/211 X |
| 4,174,338 | 11/1979 | Goller | 524/863 |
| 4,356,116 | 10/1982 | Beers . | |
| 4,358,522 | 11/1982 | Fujita | 430/303 |
| 4,410,677 | 10/1983 | Lampe | 524/588 |

FOREIGN PATENT DOCUMENTS

| | | | |
|---|---|---|---|
| 737461 | 9/1955 | United Kingdom | 101/129 |

OTHER PUBLICATIONS

"Encyclopedia of Polymer Science and Technology", vol. 12, Scientific Laboratory, U.S. Patent Office, Jul. 15, 1971.

"The Effect of Different Types and Amounts of Catalyst on the Mechanical Properties of Silicone Rubbers", Wacker-Chemie GmbH, Oct. 1981 Edition.

"Fibres, Films, Plastics and Rubbers", by W. J. Roff and J. R. Scott, Butterworth's London, 1971 (41.8 Additional Notes).

*Primary Examiner*—Clifford D. Crowder

*Attorney, Agent, or Firm*—Harness, Dickey & Pierce

[57] ABSTRACT

An ink design is silk screened onto an intermediate surface and is then transferred to an article by a deformable pad. In order to provide a large difference in the ink affinities of the intermediate surface and pad, these are made of silicone rubbers in which different catalysts are used in the curing of the rubbers. Dibutyltindilaurate as catalyst provides an intermediate surface of low ink affinity which can enable 100% transfer of ink from the intermediate surface to the pad when a stannous octoate catalyzed, condensation cured rubber, or a suitable addition cured rubber, is used for the pad. The screen is heated to a greater temperature than that of the intermediate surface.

28 Claims, 1 Drawing Sheet

Figure 1:
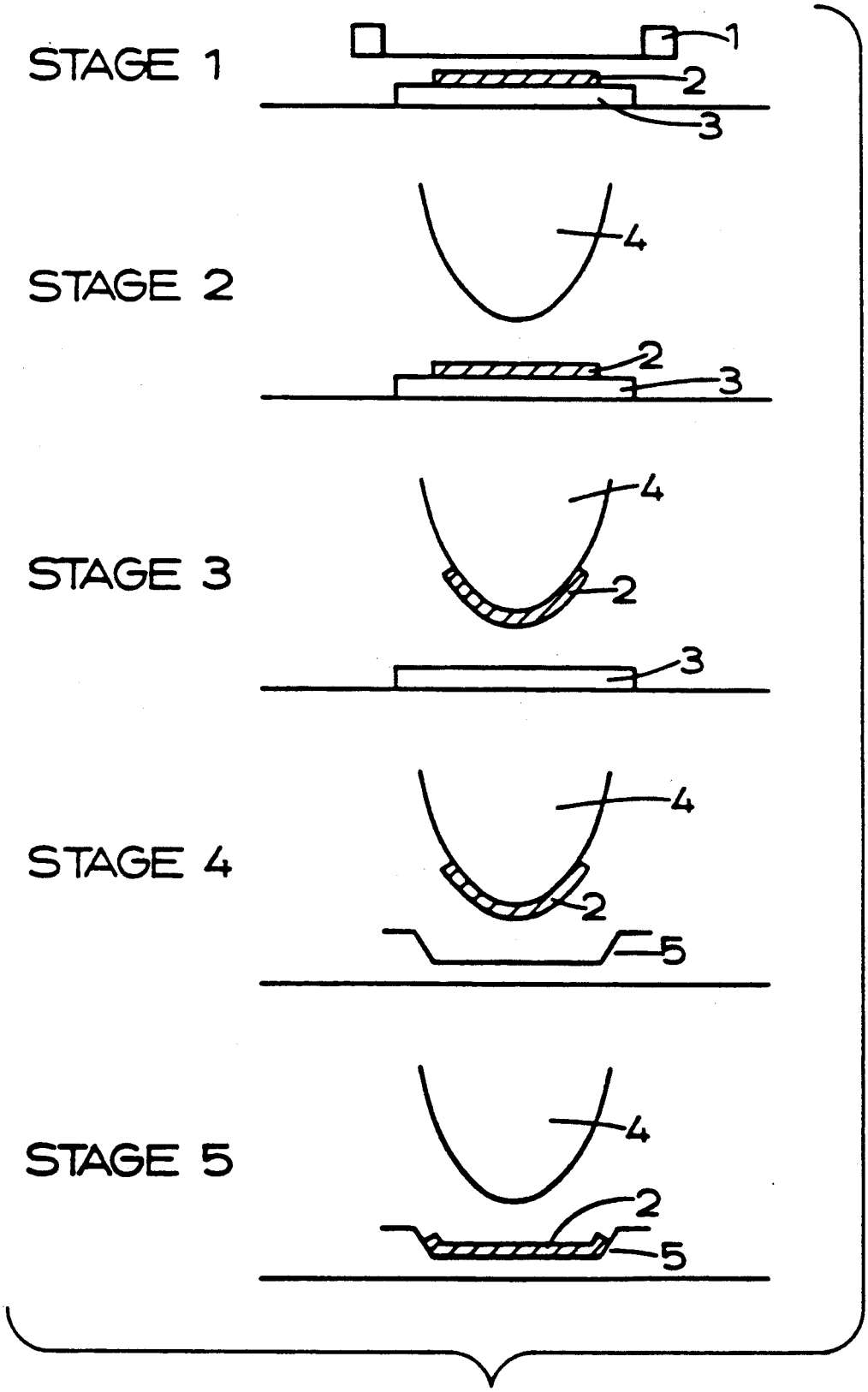

OFF-SET PRINTING BY SILK SCREENING AN INTERMEDIATE SURFACE AND TRANSFERRING THE IMAGE TO AN ARTICLE BY AN OFF-SET PAD

This is a continuation of U.S. patent application Ser. No. 720,261, filed Apr. 5, 1985, entitled Off-Set Printing, now abandoned, which was a continuation-in-part of Ser. No. 486,697 filed Apr. 20, 1983, now abandoned.

BACKGROUND AND SUMMARY OF THE INVENTION

This invention relates to repetitive off-set printing processes of the kind in which a deformable pad is employed to transfer an ink design to an article.

Off-set transfer pad processes for printing onto complex shapes are well established in the ceramic, plastics, toy, and packaging industries. The majority of these processes use a deformable gelatine or silicone rubber pad to transfer an ink design from an intaglio metal plate to the items to be decorated or marked. The metal plate can be engraved or etched.

The cost of these metal plates can be high, particularly if hand engraved. U.K. Patent Specification 737,461 has proposed replacing the intaglio metal plate by a silk screen and an intermediate flat surface. The ink design is applied to the intermediate flat surface by screen printing and then transferred to the item to be marked or decorated by means of the deformable pad. It was suggested that the intermediate surface can be any non-absorbent material, and examples of metal or glass were given. However, it was found in practice that the ink film on the intermediate surface split on removal of the deformable pad from the intermediate surface. The result was that the design ink spread with successive prints and there was a loss of definition.

In U.K. Patent Specification No. 1,602,225 it was stated that to overcome the above problem and to remove the risk of excessive buildup of ink on the intermediate surface, it was found necessary to ensure that, at each silk screen operation, the intermediate surface was free from residual colour remaining from the previous print. To achieve this, the intermediate surface may be doctored between successive prints, or half-sized paper fed from a roll, such that a fresh area of paper is presented for each screening operation.

When doctoring is employed, the efficiency of doctoring is crucial, and care has to be exercised to prevent scratching of the intermediate surface. Failure to doctor efficiently, or to prevent scratching, immediately leads to spoiled prints.

With all of the known processes, the ink film is split at each transfer operation with the further disadvantage that only some of the ink is transferred to the workpiece. Particularly, in the case of ceramics, there is a need to be able to print heavy blocks or bands of colours, and with such ink splitting processes, this is difficult to achieve.

The present invention stems from attempts to provide an improved off-set printing process, where the ink design on the intermediate surface is transferred substantially completely to the item to be marked or decorated by the deformable pad.

U.K. Patent Specification No. 804,751 suggests that the transfer of the design in its entirety from an intermediate surface to the ware to be printed can be effected by coating both the intermediate surface and the resilient pad with an adhesive layer. The fact this proposal appears never to have been exploited commercially casts doubts on the effectiveness of that method.

The basis for the present invention lies in our discovery that the relative affinity of an ink for the intermediate surface, deformable pad and workpiece can be controlled by the use of two dissimilar silicone rubbers for pad and intermediate surface, the silicone rubbers differing in the catalysts that are employed in curing of the rubbers. We have found that consistent 100% transfer of ink from intermediate surface to pad can be achieved by either of two closely related techniques:

(i) by using an addition cured rubber for the pad and a condensation cured rubber for the intermediate surface with a careful choice of the curing catalyst for the rubber of the intermediate surface.

(ii) by using condensation cured rubbers for both the pad and intermediate surface and with a careful choice of both curing catalysts for the rubbers.

U.S. Pat. No. 4,261,749 is concerned with a thermoplastic ink formulation for use in an off-set process in which an ink design is applied to a silicone elastomer intermediate surface and is then transferred to the ware by a further silicone elastomer. It is stated at lines 47 to 51 of column 4 that 'it is highly desirable to have as great a difference in surface energy as possible between the two silicone surfaces in order to facilitate ink release from one to the other', but no details are given of what rubbers are to be employed. It would appear that it was contemplated to provide different surface energies by employing different compositions of rubber, such as by varying the phenyl/methyl ratio as was previously known.

It is further stated at lines 54 to 58 of column 4 that 'the inventive materials can result in less frequent replacement of the silicone rolls or pads than is required for other presently-available thermoplastic ink formulations' and at lines 50 to 52 of column 4 that 'it has been found that the surface energy of the silicone surface increases with repeated release cycles'.

Thus, U.S. Pat. No. 4,261,749 is concerned with devising an ink formulation to accommodate changes in ink affinity of the silicone rubber surfaces which occur in use, whereas the present invention is concerned with providing substantially stable ink affinities of the two surfaces, so that the silicone rubber surfaces rarely, if ever, require replacement to alter ink affinity.

One object of the invention is to provide an off-set printing process which makes use of a substantially continuous intermediate surface and a deformable pad, wherein an ink design is applied to the intermediate surface, the deformable pad is brought into contact with the intermediate surface to pick up the design from the intermediate surface, and then the pad is brought into contact with an article to apply the design to the article, these steps being repeated successively to apply ink designs to further articles, and wherein the intermediate surface is first prepared by condensation curing a first silicone rubber, and the pad is first prepared by addition curing a second silicone rubber, the condensation curing of the first silicone rubber employing a curing catalyst chosen such that the affinity of the first silicone rubber when cured for the ink is substantially less than the affinity of the second silicone rubber when cured for the ink, such that when the deformable pad contacts the intermediate surface the design is substantially completely transferred from the intermediate surface to the pad.

By a continuous intermediate surface we mean a surface without substantial relief, as distinct from the surface of an intaglio plate. The intermediate surface will usually be a continuous flat surface.

Another object of the invention is to provide an off-set printing process which makes use of a substantially continuous intermediate surface and a deformable pad, wherein an ink design is applied to the intermediate surface, the deformable pad is brought into contact with the intermediate surface to pick up the design from the intermediate surface, and then the pad is brought into contact with an article to apply the design to the article, these steps being repeated successively to apply ink designs to further articles, and wherein the intermediate surface and the pad are first prepared by condensation curing first and second silicone rubbers respectively, the condensation curing of the first and second silicone rubbers employing first and second curing catalysts respectively, the first and second curing catalysts being chosen such that the affinity of the first silicone rubber when cured for the ink is subtsantially less than the affinity of the second silicone rubber when cured for the ink, whereby when the deformable pad contacts the intermedate surface, the design is substantially completely transferred from the intermediate surface to the pad.

These processes each avoid the need for doctoring of the intermediate surface prior to applying an ink design to the intermediate surface for printing a fresh article. Also, there is no need with either process to apply a fluid coating to either the intermediate surface or the pad to assist ink transfer.

The intermediate surface is preferably flat.

Appropriate choice of the catalysts employed in curing the silicone rubbers and control of the visco-elastic properties of the inks as described in detail hereafter enable the ink design to be transferred 100% from the intermediate surface to the workpiece. There is then no need for doctoring of the intermediate surface, with the result that the printing apparatus can be made much simpler and reliable.

The ink design may be applied to the intermediate surface by any suitable method. Preferably silk screening will be employed, but other stencilling operations may be used.

We have found that condensation type silicone rubbers having a wide range of ink affinities can be produced by employing as catalysts the carboxylic acid salts of various metals such as Pb, Zn, Zr, Sb, Fe, Cd, Sn, Ba, Ca, and Mn.

In particular, we have found that a range of ink affinities is provided by the following list of salts: metal naphtenates, octoates, hexoates, laurates, and acetates, the ink affinity generally reducing through the list.

In theory it would appear best to use a metal acetate in curing the first rubber, and a metal naphthenate in curing the second rubber, taking the extremes from the list. In practice, however, partly for the reason of availability we prefer to use a metal laurate for the first rubber and a metal octoate for the second rubber, when both rubbers are of the condensation type. We have tried using certain acetates for the first rubber but the resulting rubbers tended to be slightly unstable thereby restricting their commercial potential.

On this scale of ink affinities addition cured rubbers are at the high end of the scale.

It has been discovered that silicone rubbers of the condensation type, and using dibutyltindilaurate as the catalyst in the curing process, have much less affinity for ink than condensation cure rubbers using most other catalysts in the curing process or addition cure rubbers.

We prefer to use stannous octoate catalysed, condensation cured rubber for the pad when a dibutyltindilaurate catalysed, condensation cured rubber is used for the intermediate surface, but addition cured rubbers for the pad can also enable the process to operate effectively.

Also, it has been found preferable to heat treat the dibutyltindilaurate silicone rubber after cure, in order to stabilize its ink affinity properties relative to other silicone rubbers.

Because of its lesser affinity for ink, a stabilized dibutyltindilaurate catalysed silicone rubber provides an ideal material for the intermediate surface. It is able to accept ink from the silk screen to form a design of high definition but then, on subsequent pressure contact from a deformable pad of a suitably dissimilar silicone rubber, due to differences in ink affinity, it gives up the ink design 100% to the pad.

When screen printing of the design onto the intermediate surface is employed, it is preferable to arrange a change in the visco-elastic properties of the ink between the screen printing stage and the ink design transfer stage. The need for this change is that the visco-elastic properties of the ink required for screen printing are different from those desirable for good transfer. An ink of the correct viscosity is the prime consideration for quality screen printing whilst the tack properties of the ink can be of importance at transfer. This change in emphasis from viscosity at screen printing to tack at transfer is preferably effected by the use of heat.

An electrically heated metal screen is conveniently used, but an externally heated screen may be employed.

Additionally, the ink should be compatible with the silicone rubber of both transfer pad and intermediate surface and not induce significant deterioration in either during the period of printing. It has been found that inks meeting all the above criteria are preferably composed of a solid resin, a liquid resin, a wax, and a ceramic pigment. The wax should have a melting point below the desired silk-screen temperature and the solid resin a melting point above this temperature. Viscosity control at the silk screen is effected by adjustment to the solid/-liquid resin ratio and tack at the transfer stage by the wax to total resin ratio.

A further object of the invention is to provide an off-set machine suitable for printing with a specified ink onto the curved surface of an article, comprising a substantially continuous intermediate surface, means for applying an ink design in said ink to said intermediate surface, a deformable pad, means for bringing said deformable pad into contact with said intermediate surface to pick up said ink design, and means for bringing said pad carrying said ink design into contact with said article to transfer said ink design to said article, said intermediate surface being formed of a condensation cured silicone rubber, and said pad being formed of an addition cured silicone rubber, said rubber of said intermediate surface containing a curing catalyst chosen such that the affinity of said condensation cured silicone rubber for said ink is substantially less than the affinity of said addition cured rubber for said ink, such that in use of the machine when said deformable pad contacts said intermediate surface said ink design is substantially completely transferred from said intermediate surface to said pad without the need for doctoring of said intermediate surface, and without the need for applying a fluid coating to either said intermediate surface or said pad.

A yet further object of the invention is to provide an off-set machine suitable for printing with a specified ink onto the curved surface of an article, comprising a substantially continuous intermediate surface, means for applying an ink design in said ink to said intermediate surface, a deformable pad, means for bringing said deformable pad into contact with said intermediate surface to pick up said ink design, and means for bringing said pad carrying said ink design into contact with said article to transfer said ink design to said article, said intermediate surface and said pad being formed of first and second condensation cured silicone rubbers respectively, said first and second rubbers containing first and second curing catalysts respectively, said first and second rubbers possessing substantially different affinities resulting substantially from the use of said first and second curing catalysts in the curing of said rubbers, said difference being such that in use of the machine when said deformable pad contacts said intermediate surface said ink design is substantially completely transferred from said intermediate surface to said pad without the need for doctoring of said intermediate surface, and without the need for applying a fluid coating to either said intermediate surface or said pad.

In a preferred embodiment of the invention, an electrically heated metal screen and an ink formulation are employed such that, at the temperature of the screen, the ink viscosity is correct for screen printing. The ink in the form of the required design is screened onto the intermediate surface of stabilized dibutyltindilaurate catalysed silicone rubber which is heated to a lower temperature than the screen, such that after screening the tack properties of the ink dominate. A deformable pad of dissimilar silicone rubber, for example, addition cured or octoate-catalysed condensation cured, is used to pick up the ink design 100% from the intermediate surface. In the final stage of the operation the pad transfers the ink design 100% to the workpiece.

The process is illustrated diagrammatically in the accompanying single FIGURE in which the reference numeral 1 designates the heated silk screen, 2 designates the ink design, 3 designates the heated continuous intermediate surface, 4 designates the deformable pad, and 5 designates the workpiece.

As an illustration of the inventive processes there now follows examples of formulations for the silicone rubbers and ink together with details of operating temperatures for screen and intermediate surface. The examples selected are to demonstrate the principles of the invention and do not imply any limitation.

Silicone Rubber Transfer Pad Examples Ranges

| (A1) Addition cure*: | Parts Weight |
|---|---|
| rubber polymer | 40–60 |
| 50 cst silicone fluid | 60–40 |
| manufacturers cross linker and catalyst on the basis of 11.1% of the polymer | 4.4–6.6 |

*Based on rubber polymer ME 622 supplied by Wacker Chemicals (UK) Ltd., The Clock Tower, Mount Felix Bridgest Walton-on-Thames, Surrey KT12 1AS

| (A2) Condensation cure*: | Parts Weight |
|---|---|
| rubber Polymer | 60–90 |
| 50 cst silicone fluid | 40–10 |
| ethyl silicate on the basis of 0.5 to 2% of the polymer | 0.3–1.8 |
| stannous octoate on the basis of 0.3 to 2% of the polymer | 0.18–1.8 |

*Based on rubber polymer 573A supplied by Rhodia (UK) Ltd. Hulton House 161-166 Fleet Street LONDON EC4 2DP Silicone Rubber Intermediate Surface Example Ranges (B1) Based on rubber polymer silicoset 105 supplied by ICI Ltd. Organics Division Blackley MANCHESTER.

| | Parts Weight |
|---|---|
| rubber polymer | 60–100 |
| 50 cst silicone fluid | 40–0 |
| dibutyltindilaurate and cross linker on the basis of 0.1 to 3% of the polymer | 0.06–3 |

(B2) Based on rubber polymer 573A supplied by Rhodia (UK) Ltd. Hulton House 161-166 Fleet Street LONDON EC4 2DP

| | Parts Weight |
|---|---|
| rubber polymer | 80–100 |
| 50 cst silicone fluid | 20–0 |
| dibutyltindilaurate and cross linker as supplied in 1982 on the basis of 0.5 to 3% of the polymer | 0.4–3 |

(B3) Based on rubber polymer 573A by Rhodia (U.K.) Ltd.

| | Parts Weight |
|---|---|
| rubber polymer | 60–100 |
| 50 cst silicone fluid | 40–0 |
| ethyl silicate on the basis of 0.5 to 2% of the polymer | 0.3–2.0 |
| dibutyltindilaurate on the basis of 0.2 to 2% of the polymer | 0.12–2.0 |

It will be appreciated that either transfer pad material A1 or A2 may be employed in the process with any of the intermediate surface materials B1, B2, or B3.

The rubbers have typically 6,500 to 7,000 silicone units.

The rubber of Example (B1), (B2), or (B3) is produced as a thin uniform layer, 0.5 to 5 mms in thickness, on a metal backing. Following fabrication and cure the rubber is stabilized by heat treating for 4 h. at 110° C.

SPECIFIC PROCESS EXAMPLES OF TRANSFER PAD AND INTERMEDIATE SURFACE COMBINATIONS

Example 1 (Based on $A_2$, $B_3$)

Silicone Rubber Transfer Pad (Condensation Cure)

| | Parts Weight |
|---|---|
| rubber polymer (Polymer 573A supplied by Rhodia (U.K.) Ltd.) | 75 |
| 50 cst silicone fluid | 25 |
| ethyl silicate | 0.75 |
| stannous octoate | 0.25 |
| Hardness 40 Shore 00 | |

Intermediate Surface (Condensation Cure)

| | Parts Weight |
|---|---|
| rubber polymer (Polymer 573A supplied by Rhodia (U.K.) Ltd.) | 75 |
| 50 cst silicone fluid | 25 |
| ethyl silicate | 0.75 |
| dibutyl tin dilaurate | 0.19 |

It will be noted that with this example the only difference between the rubbers of the pad and intermediate surface is the catalyst.

Example 2 (Based on $A_2$, $B_1$)

Silicone Rubber Transfer Pad (Condensation Cure)

| | Parts Weight |
|---|---|
| rubber polymer (Polymer 573A supplied by Rhodia (U.K.) Ltd.) | 85 |
| 50 cst silicone fluid | 15 |
| ethyl silicate | 0.85 |
| stannous octoate | 0.26 |
| Hardness 47 Shore 00 | |

Intermediate Surface (Condensation Cure)

| | Parts Weight |
|---|---|
| rubber polymer (Polymer 'Silicoset 105' supplied by I.C.I. Ltd. with ethyl silicate added to polymer by the supplier.) | 75 |
| 50 cst silicone fluid | 25 |
| dibutyl tin dilaurate | 0.19 |

Example 3 (Based on $A_1$, $B_1$)

Silicone Rubber Transfer Pad (Addition Cure)

| | Parts Weight |
|---|---|
| rubber polymer (Polymer 622 supplied by Wacker Chemicals (U.K.) Ltd.) | 50 |
| 50 cst silicone fluid | 50 |
| platinum chloride catalyst | 5.5 |
| Hardness 37 Shore 00 | |

Intermediate Surface (Condensation Cure)

| | Parts Weight |
|---|---|
| rubber polymer (Polymer 'Silicoset 105' supplied by I.C.I. Ltd. with ethyl silicate added to polymer by supplier.) | 60 |
| 50 cst silicone fluid | 40 |
| dibutyl tin dilaurate | 0.15 |

Example 4 (Based on $A_1$, $B_1$)

Silicone Rubber Transfer Pad (Addition Cure)

| | Parts Weight |
|---|---|
| rubber polymer (Polymer 622 supplied by Wacker Chemicals (U.K.) Ltd.) | 60 |
| 50 cst silicone fluid | 40 |
| platinum chloride catalyst | 6.6 |
| Hardness 44 Shore 00 | |

Intermediate Surface (Condensation Cure)

| | Parts Weight |
|---|---|
| rubber polymer (Polymer 'Silicoset 105' supplied by I.C.I. Ltd. with ethyl silicate added to polymer by supplier.) | 75 |
| 50 cst silicone fluid | 25 |
| dibutyl tin dilaurate | 0.19 |

Example of Ink Formulation

| (C) | Parts Weight |
|---|---|
| Staybelite Ester Resin 3 | 64.8 |
| Staybelite Ester Resin 10 | 17.6 |
| Polyethylene Glycol 1500 | 17.6 |
| Pigment | 200.0 |

The ink is produced by intimate mixing either by bead or triple roll mill.

Staybelite resins are supplied by
Hercules Ltd.
20, Red Lion Street
LONDON WC1R 4PB

Typical Operating Temperatures

Silk-screen: 60°–100° C.
Intermediate Surface: 30°–45° C.

We claim:

1. An off-set printing process comprising: forming a substantially continuous intermediate surface and a deformable pad, applying an ink design to said intermediate surface by silk screening, bringing said deformable pad into contact with said intermediate surface to pick up said design from said intermediate surface, and bringing said pad into contact with an article having a complex surface to apply said design to said article, said applying, bringing said deformable pad in contact with said intermediate surface, and bringing said pad in contact with an article steps being repeated successively to apply ink designs to further articles, wherein said forming step comprises condensation curing first and second silicone rubbers to provide said intermediate surface and said pad respectively, the condensation curing of said first and second silicone rubbers employing first and second curing catalysts respectively, said first and second curing catalysts being chosen such that the affinity of said first silicone rubber when cured for the ink is substantially less than the affinity of said second silicone rubber when cured for the ink, whereby when said deformable pad contacts said intermediate surface said design is substantially completely transferred from said intermediate surface to said pad thereby avoiding the need for doctoring of said intermediate surface prior to repetition of said applying, bringing said deformable pad in contact with said intermediate surface, and bringing said pad in contact with an article steps with a fresh article, or the need for applying a fluid coating to either said intermediate surface or said pad.

2. A process as claimed in claim 1 in which said first and second curing catalysts are carboxylic acid salts of metals.

3. A process as claimed in claim 2 in which said first curing catalyst is a metal laurate.

4. A process as claimed in claim 3 in which said first curing catalyst is a dibutyl metal dilaurate.

5. A process as claimed in claim 4 in which said first curing catalyst is dibutylindilaurate.

6. A process as claimed in claim 5 in which said curing catalyst stannous octoate.

7. A process as claimed in claim 3 in which said second curing catalyst is a metal octoate.

8. A process as claimed in claim 1 in which said first step comprises heat treating said first silicone rubber after curing thereof.

9. An off-set printing process comprising: forming a substantially continuous intermediate surface and a deformable pad, applying an ink design by silk screen method to said intermediate surface, bringing said deformable pad into contact with said intermediate surface to pick up said design from said intermediate surface, and bringing said pad into contact with an article having a complex surface to apply said design to said article, said applying, bringing said deformable pad in contact with said intermediate surface, and bringing said pad in contact with an article steps being repeated successively to apply ink designs to further articles, wherein said forming step comprises condensation curing a first silicone rubber to provide said intermediate surface, and addition curing a second silicone rubber to provide said pad, the condensation curing of said first silicone rubber employing a curing catalyst chosen such that the affinity of said first silicone rubber when cured for the ink is substantially less than the affinity of said second silicone rubber when cured for the ink, whereby when said deformable pad contacts said intermediate surface said design is substantially completely transferred from said intermediate surface to said pad thereby avoiding the need for doctoring of said intermediate surface prior to repetition of said applying, bringing said deformable pad in contact with said intermediate surface, and bringing said pad in contact with an article steps with a fresh article, or the need for applying a fluid coating to either said intermediate surface or said pad.

10. A process as claimed in claim 9 in which said catalyst is a carboxylic acid salt of a metal.

11. A process as claimed in claim 10 in which said salt is a metal laurate.

12. A process as claimed in claim 11 in which said salt is dibutyltindilaurate.

13. A process as claimed in claim 9 in which said first silicone rubber is heat treated after curing so as substantially to stabilize its ink affinity properties.

14. A repetitive off-set printing process comprising: applying an ink design to a substantially continuous intermediate surface, bringing a deformable pad into contact with said intermediate surface to pick up said design from said intermediate surface, and bringing said pad into contact with said article to transfer said design to said article, said intermediate surface being of a condensation cured metal laurate-catalysed silicone rubber of relatively low affinity for said ink, and said pad being of a condensation cured metal octoate-catalysed silicone rubber of relatively high affinity for said ink, whereby when said deformable pad contacts said intermediate surface said design is substantially completely transferred from said intermediate surface to said pad without the need for doctoring of said intermediate surface prior to the repetition of said steps with a fresh article, or the need for applying a fluid coating to either said intermediate surface or said pad.

15. A process as claimed in claim 14 in which said pad is of a condensation cured stannous octoate-catalysed silicone rubber, and said intermediate surface is of a condensation cured dibutyltindilaurate-catalysed silicone rubber.

16. An off-set machine suitable for printing with a specified ink onto the curved surface of an article, comprising: a substantially continuous intermediate surface, means for applying an ink design in said ink to said intermediate surface, a deformable pad, means for bringing said deformable pad into contact with said intermediate surface to pick up said ink design, and means for bringing said pad carrying said ink design into contact with said article to transfer said ink design to said article, said intermediate surface and said pad comprised of first and second condensation cured silicone rubbers respectively, said first and second rubbers including first and second curing catalysts respectively, said first and second rubbers possessing substantially different affinities for said ink, the difference in said affinities resulting substantially from the use of said first and second curing catalysts in the curing of said rubbers, said difference being such that in use of the machine when said deformable pad contacts said intermediate surface said ink design is substantially completely transferred from said intermediate surface to said pad without the need for doctoring of said intermediate surface, and without the need for applying a fluid coating to either said intermediate surface or said pad.

17. A machine as claimed in claim 16 in which said first and second curing catalysts are carboxylic acid salts of metals.

18. A machine as claimed in claim 17 in which said first curing catalyst is a metal laurate.

19. A machine as claimed in claim 18 in which said second curing catalyst is a metal octoate.

20. A machine as claimed in claim 18 in which said first curing catalyst is dibutyltindilaurate and said second curing catalyst is stannous octoate.

21. A machine as claimed in claim 16 in which said means for applying an ink design comprises a silk screen.

22. An off-set machine suitable for printing with a specified ink onto the curved surface of an article, comprising: a substantially continuous intermediate surface, means for applying an ink design to said intermediate surface, a deformable pad, means for bringing said deformable pad into contact with said intermediate surface to pick up said ink design, and means for bringing said pad carrying said ink design into contact with said article to transfer said ink design to said article, said intermediate surface comprised of a condensation cured silicone rubber, and said pad comprised of an addition cured silicone rubber, said rubber of said intermediate surface including a curing catalyst chosen such that the affinity of said condensation cured silicone rubber for said ink is substantially less than the affinity of said addition cured rubber for said ink, such that in use of the machine when said deformable pad contacts said intermediate surface said ink design is substantially completely transferred from said intermediate surface to said pad without the need for doctoring of said intermediate surface, and without the need for applying a fluid coating to either said intermediate surface or said pad.

23. A machine as claimed in claim 22 in which said curing catalyst is a carboxylic acid salt of a metal.

24. A machine as claimed in claim 23 in which said curing catalyst is a metal laurate.

25. A machine as claimed in claim 24 in which said curing catalyst is dibutyltindilaurate.

26. A machine as claimed in claim 22 in which said means for applying an ink design comprises a silk screen.

27. An off-set machine suitable for printing with a specified ink onto the curved surface of an article, comprising: a substantially continuous intermediate surface, means for applying an ink design in said ink to said intermediate surface, a deformable pad, means for bringing said deformable pad into contact with said intermediate surface to pick up said ink design, and means for bringing said pad carrying said ink design into contact with said article to transfer said ink design to said article, said continuous intermediate surface and pad both formed of the same condensation cured silicone rubber having about 6,500 to 7,000 silicone units, said surface and pad each having been cured by a catalyst selected from the group consisting of carboxylic acid salts of metal, the metal having been selected from the group consisting of Pb, Zn, Zr, Sb, Fe, Cd, Sn, Ba, Ca, Mn and combination thereof, and the metallic salts having been selected from the group consisting of metal naphtenates, metal octoates, metal hexoates, metal laurates, metal acetates and combinations thereof, such that said first and second rubbers possess substantially different affinities for said ink, the difference in said affinities resulting from the selection of said first and second curing catalysts in the curing of said rubbers such that said catalysts are different, said difference in affinities being such that in use of the machine when said deformable pad contacts said intermediate surface said ink design is substantially completely transferred from said intermediate surface to said pad without the need for doctoring of said intermediate surface, and without the need for applying a fluid coating to either said intermediate surface or said pad.

28. An off-set printing process comprising: providing a substantially continuous intermediate surface being formed of condensation cured silicone rubber having about 6,500 to 7,000 silicone units, said surface being cured by a catalyst selected from the group consisting of carboxylic acid salts of metal, the metal being selected from the group consisting of Pb, Zn, Zr, Sb, Fe, Cd, Sn, Ba, Ca, Mn and combinations thereof, and the metallic salts being selected from the group consisting of metal naphtenates, metal octoates, metal hexoates, metal laurates, metal acetates and combinations thereof, providing a pad being formed of condensation cured silicone rubber having about 6,500 to 7,000 silicone units, said surface being cured by a catalyst selected from the group consisting of carboxylic acid salts of metal, the metal being selected from the group consisting of Pb, Zn, Zr, Sb, Fe, Sn, Ba, Ca, Mn and combinations thereof, and the metallic salts being selected from the group consisting of metal naphtenates, metal octoates, metal hexoates, metal laurates, metal acetates and combinations thereof, such that when cured, the intermediate surface affinity for ink is substantially less than the affinity for ink of the cured pad, the difference in affinities resulting substantially from the selection of different curing catalysts in the curing of said intermediate surface and pad, applying an ink design to said intermediate surface, contacting said intermediate surface with said pad, transferring said design from said intermediate surface to said pad such that said design is substantially completely transferred from said intermediate surface to said pad, contacting an article with said pad to apply said design to said article, repeating said applying, contacting, transferring and contacting steps successively to apply ink designs to further articles, and avoiding the need for doctoring of said intermediate surface prior to repetition of said applying, contacting, transferring and contacting steps with a fresh article, and avoiding the need for applying a fluid coating to either said intermediate surface or said pad.

* * * * *

UNITED STATES PATENT AND TRADEMARK OFFICE

CERTIFICATE OF CORRECTION

PATENT NO. : 5,054,390

DATED : October 8, 1991

INVENTOR(S) : John F. Birtles, et al.

It is certified that error appears in the above-identified patent and that said Letters Patent is hereby corrected as shown below:

Title Page, The Title, "Off-Set Printing By Silk Screening An Intermediate Surface and Transferring The Image To An Article By An Off-Set Pad" should be --Off-Set Printing Including By Silk-Screening An Intermediate Surface And Transferring The Image To An Article By An Off-Set Pad--

Col. 1, lines 1-5, "Off-Set Printing By Silk Screening An Intermediate Surface And Transferring The Image To An Article By An Off-Set Pad" should be --Off-Set Printing Including By Silk-Screening An Intermediate Surface And Transferring The Image To An Article By An Off-Set Pad--

Col. 9, line 25, "dibutylindilaurate" should be --dibutyltindilaurate--

Col. 9, line 27, after "catalyst" insert --is--

Signed and Sealed this

Thirteenth Day of April, 1993

*Attest:*

STEPHEN G. KUNIN

*Attesting Officer*

*Acting Commissioner of Patents and Trademarks*